United States Patent [19]

Masuko et al.

[11] Patent Number: 4,839,993

[45] Date of Patent: Jun. 20, 1989

[54] POLISHING MACHINE FOR FERRULE OF OPTICAL FIBER CONNECTOR

[75] Inventors: Takayuki Masuko, Tokyo; Norio Suzuki, Yokohama; Kaoru Moriya, Yokohama, all of Japan

[73] Assignee: Fujisu Limited, Kawasaki, Japan

[21] Appl. No.: 3,803

[22] Filed: Jan. 16, 1987

[30] Foreign Application Priority Data

| | | | |
|---|---|---|---|
| Jan. 28, 1986 | [JP] | Japan | 61-016310 |
| Mar. 14, 1986 | [JP] | Japan | 61-038033 |
| May 30, 1986 | [JP] | Japan | 61-081948[U] |
| Jul. 30, 1986 | [JP] | Japan | 61-179357 |

[51] Int. Cl.[4] ..... B24B 5/00

[52] U.S. Cl. ..... 51/129; 51/124 R; 51/237 M; 51/272

[58] Field of Search ..... 51/121, 129, 124 R, 51/131.1, 129, 133, 272, 132, 131.3, 237 M

[56] References Cited

U.S. PATENT DOCUMENTS

| | | | |
|---|---|---|---|
| 1,489,317 | 4/1924 | Faulkner | 51/132 |
| 2,075,216 | 3/1937 | Mancuso | 51/133 |
| 2,860,451 | 11/1958 | Deakin | 51/124 R |
| 3,224,148 | 12/1965 | Mitchell | 51/129 |
| 3,305,975 | 2/1967 | Maier | 51/124 |
| 3,549,439 | 12/1970 | Kaueggiá et al. | 51/121 |
| 3,863,395 | 2/1975 | Brown | 51/121 |
| 4,010,574 | 2/1977 | Feierabend et al. | 51/124 R |
| 4,287,687 | 9/1981 | Wilson | 51/237 M |
| 4,680,893 | 7/1987 | Cronkhite et al. | 51/131.3 |
| 4,726,150 | 2/1988 | Nishio et al. | 51/237 M |

*Primary Examiner*—Frederick R. Schmidt
*Assistant Examiner*—Robert Showalter
*Attorney, Agent, or Firm*—Staas & Halsey

[57] ABSTRACT

A polishing machine for polishing the end faces of ferrules supporting coaxially aligned optical fibers to be connected in an optical fiber connector. The machine has a polishing disk composed of a rotating disk with a flat face, a rubber plate fixed on the rotating disk, and a thin metal elastic plate mounted on the rubber plate. The surface of the polishing disk is capable of being indented when the end face of a ferrule is pressed against the surface of the polishing disk. So, by passing the end face of the ferrule against the rotating polishing disk, and rotating the ferrule around its axis alternately to the left and right, the end face of the ferrule is polished approximately spherically. A revolving motion may be included for the ferrule. The curvature of the polished end face is determined by the force used to press the ferrule toward the polisher and the elasticity for the polishing disk. The surface of the polishing disk may be provided with a series of grooves arranged in a mesh pattern to catch and retain the abrasives, and when the ferrule approaches to the grooves, the abrasives gush out of the grooves to wet the end face to be polished. So, the polishing is done very smoothly. The chuck for clamping the ferrule is mountable and demountable from the polishing machine, while the ferrule is clamped therein. This makes the handling of the machine very easy, and prevents contamination and stain by abrasives.

4 Claims, 11 Drawing Sheets

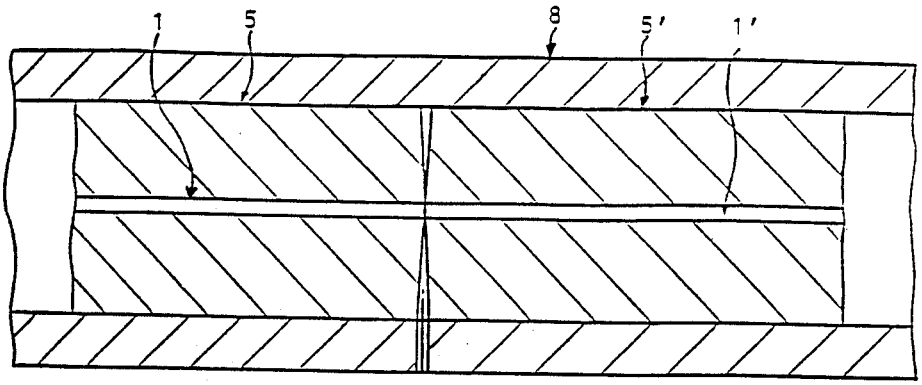
FIG. 5 PRIOR ART
FIG. 6(a)
PRIOR ART
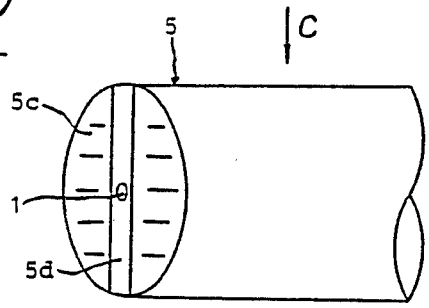
FIG. 6(b)
PRIOR ART
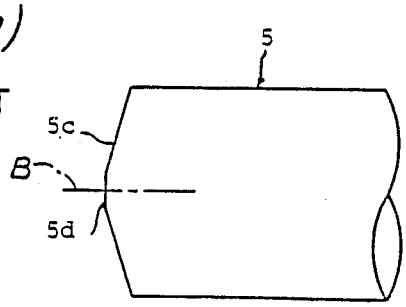

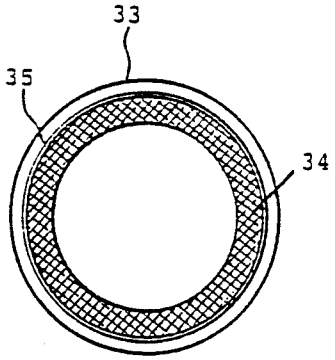
FIG. 12
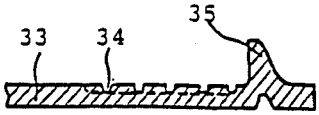
FIG. 13
FIG. 14(a)
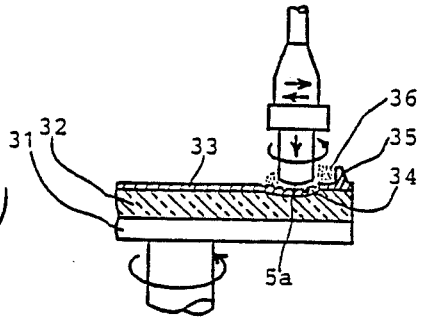
FIG. 14(b)
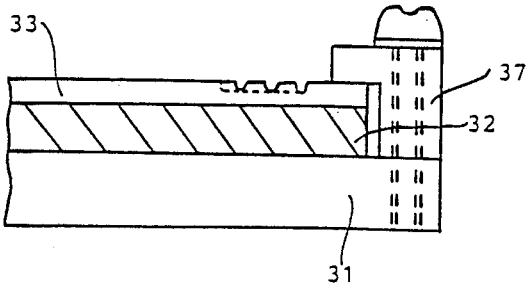

POLISHING MACHINE FOR FERRULE OF OPTICAL FIBER CONNECTOR

BACKGROUND OF THE INVENTION

The present invention relates to optical fiber connectors for connecting optical fibers in a variety of optical communication apparatuses, and more precisely to a method for polishing the end faces of ferrules for axially supporting optical fibers in optical fiber connectors, and to a machine for polishing the end faces of such ferrules.

Presently, optical fibers are used as transmission lines in the field of telecommunication to increase transmission capacity. It is known that optical fibers may be joined by fusion splicing wherein the end faces of the optical fibers are permanently connected by adhesion or welding, or by use of a disconnectable optical fiber connector. When optical connectors are used, axial deviation of the fibers must be held to less than 1/10 of their diameters and good contact between the end faces of the fibers is required. In order to meet such requirements, end face contact type optical connectors are often used. In such connectors, a ferrule is attached to the end portion of each optical fiber, and the ferrules at the fiber ends to be connected are respectively inserted from opposite ends of a sleeve. The end faces of the ferrules are butted against each other, and the ferrules are fixed in position by tightening the sleeve using a coupling nut.

FIG. 1 illustrates an optical fiber having one of its ends attached to a ferrule to be connected in a connector. In FIG. 1, the reference numeral 1 denotes an optical fiber, and the numeral 2 designates a secondary coated optical fiber formed by covering the circumference of an optical fiber 1 with a coating material such as nylon, etc. The circumference of secondary coated optical fiber 2 is braided with high tensile strength tension members 4, and members 4 are covered with a coating of polyvinylchloride (PVC) etc. to form an optical cable 3. A cylindrical ferrule 5 has a chip 6 and one of its end, and an axial capillary centered with high accuracy extends through chip 6. The outer coating and the tension members 4 are cut away from cable 3 at one end to expose the secondary coated optical fiber 2, and the latter is also cut away at a position near the end face of the connecting point to expose a length of fiber 1. The exposed length of optical fiber 1 is inserted into the center capillary of chip 6 as shown in FIG. 1. The exposed secondary coated optical fiber 2 is inserted into the ferrule and is fixed therein, using, for example, an epoxy resin adhesive. The end faces of optical fibers to the connected are polished together with their respective ferrules, and the same are coaxially aligned by insertion into a common sleeve. Ferrule 5 may be provided with a flange 7, as shown in FIG. 1, and such flange may be used for manipulating and positioning ferrule 5.

In optical fiber connectors of the type described, connection losses are greatly influenced by the accuracy of the cutting of the end faces of the ferrules. For example, as shown in FIG. 2, due to mechanical inaccuracies of polishing machines, end faces 5*a* of ferrules 5 are often polished so that the faces 5*a* are inclined at an angle $\alpha$ relative to the plane extending at right angles to the longitudinal axis of the ferrules 5.

With reference to FIG. 3, it can be seen that when a ferrule 5 having an incorrectly polished end face 5*a* is inserted into a sleeve 8 and is abutted against the end face 5'*a* of another ferrule 5', a gap G is formed between the end faces of the optical fibers 1 and 1'. In practice, such gap G is apt to vary in many ways due to backlash of the polisher. This causes a multi-reflection situation and interference in the transmission of light between the end surfaces of the optical fibers 1 and 1', resulting in increased and fluctuating connection losses. Therefore, stable and effective connections are difficult to achieve. On the other hand, if the gap G is very large, in the order of 8–10 μm or more, for example, fluctuations in connection loss are reduced, but the connection loss itself is increased.

DESCRIPTION OF PRIOR ART

Prior art methods and mechanisms employed to overcome the above mentioned problems will now be explained briefly. Since it is very difficult to polish the end faces of ferrules at perfect right angles, various optional configurations have been proposed for finishing the ferrule end surfaces. In one such proposal, as shown in FIG. 4, the end faces 5*b* are polished so as to present a pyramid shape around the optical fiber 1, and such end faces are placed in abutment with one another within a sleeve 8 as shown in FIG. 5 which illustrates a cross-sectional view of the connector. FIG. 5 illustrates the sleeve 8, left and right optical fibers 1 and 1' and respective ferrules 5 and 5'.

In a second proposal, as shown in FIG. 6, the end face of each ferrule 5 is finished in the shape of a roof, as shown in FIG. 6(*a*), so as to extend downwardly on both sides 5*c* from a center beam 5*d*. FIG. 6(*b*) is a side elevational view of the ferrule of FIG. 6(*a*) taken in the direction of arrow C. The opposed ferrules are brought into contact with each other at the center portions of the beams 5*d* while keeping the respective beams 5*d* arranged orthogonally relative to each other.

In a third proposal, the end faces of the ferrules are polished so as to have a spherical configuration, and the spherical end faces of the optical fibers to be connected are brought into direct facing contact with one another. This arrangement provides the remarkable result of low and stable connection loss, because the gap G between the left and right ferrules has been eliminated. Details of such an arrangement are described in the Japanese Pat. No. 60-58446 by M. Sasaki et al., Dec. 20, 1985.

A variety of polishing machines have been developed for practicing the above mentioned proposals. The principles of such polishing machines are schematically illustrated with the sectional views of FIG. 7.

FIG. 7(*a*) illustrates a firs type of prior art polisher. This polisher basically comprises a rotating polishing plate 10 (rotating in the direction of arrow mark D) which has a flat upper surface. A rotatable disk type ferrule holder plate 11 holds and fixes the position of ferrule 5 providing an inclination at an angle $\beta$ from the axis A of the rotating polishing plate 10. The end face 5*a* is pressed toward the upper surface 10*a* of the rotating polishing plate 10. Thus, the end face 5*a* is polished to present an inclined surface having an inclination $\beta$ from a plane disposed orthogonally to the axis B of the ferrule 5. The polishing is performed by the rotary motion of the rotating polishing plate 10 and the counter rotary motion of the ferrule holder plate 11 which rotates in the direction of arrow mark E, in the opposite direction to the rotation of polishing plate 10.

After the end face has been polished with an inclination angle $\beta$, then the ferrule is rotated either 90° or 180° around its axis B, and it is again pressed against holder plate 10 to be polished in a similar manner to that described above. In such a manner, the end face of the ferrule may be finished as shown in FIG. 4 or FIG. 6.

FIG. 7(*b*) illustrates schematically a second type of prior art polisher. Basically, this polisher comprises a rotating polisher plate 12 which has a conical surface having an elevation angle of $\beta$ from the horizontal surface. The ferrule 5 is held by a ferrule holder 13 keeping its axis B parallel to the axis A of the rotating polishing plate 12. The end face 5*a* of the ferrule is pressed toward the conical surface 12*a* of the rotating polishing plate 12. So, the end face 5*a* is polished so that its surface is inclined from a horizontal plane by an angle $\beta$. Then the ferrule is rotated around its axis by an angle of 180° or 90°, and it is again pressed against surface 12*a*. In such a manner, the end face of the ferrule is again finished as shown in FIGS. 4 or 6.

In the polisher of FIG. 7(*b*), the ferrule 5 may be finished without being rotated around its axis B as described above. Namely, after the polishing at position B in FIG. 7(*b*) is complete, the ferrule may be shifted horizontally to position B' which is a symmetrical position relative to position B around the axis A of the rotating polishing plate 12, and polished again. Thus, the ferrule will be finished as shown in FIG. 6. It will be apparent, that if such shifting and polishing is repeated four times each time shifting the polishing position 90° around the axis A, the ferrule will be finished as shown in FIG. 4.

FIG. 7(*c*) illustrates schematically a third type of polishing machine which has recently be put into practical use. The machine of FIG. 7(*c*) can finish the end face of the ferrule almost spherical, to thus provide a connector having remarkably improved loss and stability. A polishing dish 14 has a spherical polishing surface 15 of a predetermined curvature. The ferrule 5 is loaded into a support means 16 which holds the axis of the ferrule perpendicularly to the polishing surface 15. When the driver shaft 17 of the polishing dish 14 is rotated, the end face of the ferrule is polished so as to conform to the spherical surface of the polishing surface 15. Details of such a polishing machine are described in Japanese Laid Open Pat. Nos. 61-142062 and 61-142063 by T. Masuko et al., June 28, 1986.

In the FIG. 7(*a*) and 7(*b*) examples of the prior art polishing machine, the positioning of the ferrule relative to the ferrule holder must be changed twice or four times in steps involving 180° and 90° rotation around its axis or shifting of its position. Such resetting requires precise adjustments. So, the preparation work is troublesome and the steps involved in the polishing process are increased, resulting in low productivity and high cost. In the FIG. 7(*c*) example, the prior art polisher has another problem, in that it is difficult to cause the ferrule to uniformly contact the polishing surface, and thus the polishing surface is likely to be worn out unevenly, so the polished surface is lacking in reproducibility. Moreover, when the surface of the polishing dish is worn, its repair and replacement are very troublesome.

Additionally, in these prior art devices, the ferrule 5 is inserted directly into a hole in the support means (11, 13, or 16), therefore, polishing agent often enters into the insertion hole and stains it, and thus the positioning accuracy of ferrule 5 is lost.

SUMMARY OF THE INVENTION

The present invention has been proposed under such background and it is an object of the present invention, therefore, to provide a machine for spherically polishing the end faces of ferrules by a simple mechanism but providing a good finish for connecting the optical fibers in a connector.

Another object of he present invention is to provide a polisher for ferrules of optical fiber connectors which assures a low loss and high reproducibility of the connection in a manner suitable for mass production.

A further object of the invention is to provide a polisher which is easy to handle, and which is protected from contamination or stain by splashed abrasives.

A first feature of the present invention is that an elastic material such as rubber is placed on rotatable polishing plate, and a thin elastic metal plate is adhered thereon. The surface of the metal plate is coated with an abrasive, and the plate is rotated. The end face of the ferrule to be polished is pressed perpendicularly against the rotating thin metal plate, and the ferrule is rotated to the left and right around its own axis. The thin metal plate is indented by the pressure of the ferrule, so that the end face is polished almost spherically in accordance with the curvature of the indention in the polishing plate. The radius of the indention in the polishing plate, and hence the curvature of the polished end face, can be adjusted by the pressure of the ferrule. During the polishing, the ferrule can be further revolved around its own axis. This prevents uneven wearing of the polishing plate, and polishes the end face so as to present a more perfect sphere.

A second feature of the present invention is that on the surface of said thin metal polishing plate, mesh patterned grooves are provided in order to continuously and uniformly supply the abrasives to the end face of the ferrule to be polished. Without such grooves, the abrasives may be pushed aside by the ferrule and fall from the perimeter of the polishing plate, and the abrasives may move away from the contact point of the ferrule and the polishing plate. However, if such grooves are provided, the abrasives are always retained in the grooves. And when the polishing surface is warped by the pressure of the ferrule, the abrasives overflow from the grooves and are always in contact with the end face of the ferrule. Therefore, the abrasives always work effectively assuring a good smooth polishing operation.

A collar may be provided on the circumference of the polishing plate in order to prevent the abrasives from leaving the surface of the polishing plate. So, a constant amount of the abrasives will always be kept on the polishing surface ensuring a uniform polishing. The collar may be screwed to the rotating disk in a manner to keep the thin metal polishing plate pressed toward the elastic plate. This simplifies replacement of the polishing plate when it is worn.

A third feature of the present invention is that a demountable chuck is provided for a polishing machine. When the ferrule is to be mounted in or removed from the chuck, the chuck is detached from the machine. Therefore, the mounting and demounting of the ferrule in the machine is very easy, and contamination of the ferrule or the chuck by the abrasives may be prevented. Moreover, a plurality of ferrules can be polished at the same time by using a plurality of such chucks.

The present invention further provides means for preventing damage to optical fibers caused by twisting thereof due to the motion of the ferrule holder (chuck) during the polishing.

The principles and fundamental structure and of the polisher of the present invention will be briefly explained referring to FIGS. 8(*a*) and 8(*b*). FIG. 8(*a*) is a schematic side elevation view illustrating the major components of the polishing machine, and FIG. 8(*b*) is an enlarged partial view of the machine. The polishing plate 20 of the present invention is formed by bonding an elastic plate 22 onto a disk type rotatable plate 21, which has a flat upper surface. The elastic plate 22 may be constructed of rubber for example. A thin polishing plate 23 is bonded onto aid elastic material 22. The rotatable polishing plate 20 is rotated around its axis, the ferrule 5 is held so that its end face is in contact with the upper surface of the rotatable polishing plate 20, and the ferrule 5 itself is rotated around its axis alternately to the left and right within a predetermined angle of rotation.

When the ferrule 5 is pressed longitudinally toward the rotating polishing plate 20, the polishing plate is indented due to its thinness and the presence of the elastic plate 22, as shown in FIG. 8(*b*). Thus, the end face 5*a* of the ferrule 5 is polished almost spherically in accordance with the depression or indentation of the surface of the polishing plate 23. The curvature of the polishing surface can be varied by choice of the thickness and elasticity of the elastic plate 22, the elasticity of the polishing plate and the pressure used to press the ferrule toward the polishing plate. Therefore, if the material and thickness of the elastic plate and the polishing plate are properly chosen, the end face of the ferrule can be easily finished to have a predetermined curvature by holding constant the pressure applied to the ferrule to press it toward the polishing plate. Moreover, the curvature can be varied to some extent simply by varying the pressure.

Other features and advantages of the present invention over prior art polishers will be apparent from the detailed description of the preferred embodiments and associated drawings.

BRIEF DESCRIPTION OF THE DRAWINGS

FIG. 5 is a schematic sectional view which illustrates the connection of ferrules which have end faces finished like a pyramid.

FIG. 6 is a series of schematic views of a ferrule having its end face polished like a roof, wherein:

FIG. 6(*a*) is a perspective view of the ferrule; and

FIG. 6(*b*) is a side elevation view taken from the direction of the arrow C.

FIG. 7 is a series of schematic side elevation views which illustrate the operational principles of three types of prior art polishing machines, wherein:

FIG. 7(*a*) illustrates a first type of polisher which polishes the ferrule by pressing it at an inclination against a flat polishing plate;

FIG. 7(*b*) illustrates a second type of polisher which polishes the ferrule by pressing it perpendicularly against a conically tapered polishing plate; and FIG. 7(*c*) illustrates a third type of polisher which polishes the ferrule by pressing it against a concave spherical surface.

FIG. 8 is a series of schematic side elevation views which illustrate the principles of operation of the polishing mechanism of the present invention, wherein:

FIG. 8(*a*) is a side elevation view of the major components of the polisher; and FIG. 8(*b*) is an enlarged view of the portions of the polisher nearest the contact point of the ferrule and polishing surface.

FIG. 9 is a series of schematic views which illustrate the principal mechanisms of an embodiment of the present invention, wherein:

FIG. 9(*a*) is a side elevation view; and

FIG. 9(*b*) is a plan view.

FIG. 12 is a schematic view which illustrates the upper surface of polishing plate which is provided with grooves having a mesh like pattern.

FIG. 13 is a partial cut-out enlarged view of the polishing plate shown in FIG. 12.

FIG. 14 is a series of schematic side elevation views which illustrates the polishing conditions of a polishing machine which uses the polishing plate of the present invention, wherein:

FIG. 14(*a*) shows how the abrasives are supplied to the lower surface of the ferrule to be polished; and FIG. 14(*b*) illustrates how a ring collar fixes the polishing plate on the elastic plate.

FIG. 15 is a series of views to illustrate the mounting of an optical cable in a chuck, wherein:

FIG. 15(*a*) is a partially cut-out side elevation view which illustrates the structure of the chuck and holder part to be used in an embodiment of polishing machine of the present invention; and FIG. 15(*b*) is a sectional view taken along the line LL in FIG. 15(*a*) illustrating the structure of means for preventing the optical cable from twisting.

FIG. 17 is a series of overall views of a polishing machine embodying the present invention, wherein:

FIG. 17(*a*) is a front elevation view; and

FIG. 17(*b*) is a side elevation view.

FIG. 18 and FIG. 19 are graphs comparing the characteristics of optical fiber connectors polished using the polishing machine of the present invention with those of optical fiber connectors polished using a prior art polisher, wherein:

FIG. 18 is a graph comparing values and dispersion of return loss of optical fiber connectors; and FIG. 19 is a graph comparing values and dispersion of connection loss of optical fiber cables.

Throughout the drawings, the same reference numerals have been used to designate the same or similar parts.

DETAILED DESCRIPTION OF PREFERRED EMBODIMENTS

Figure 9A:
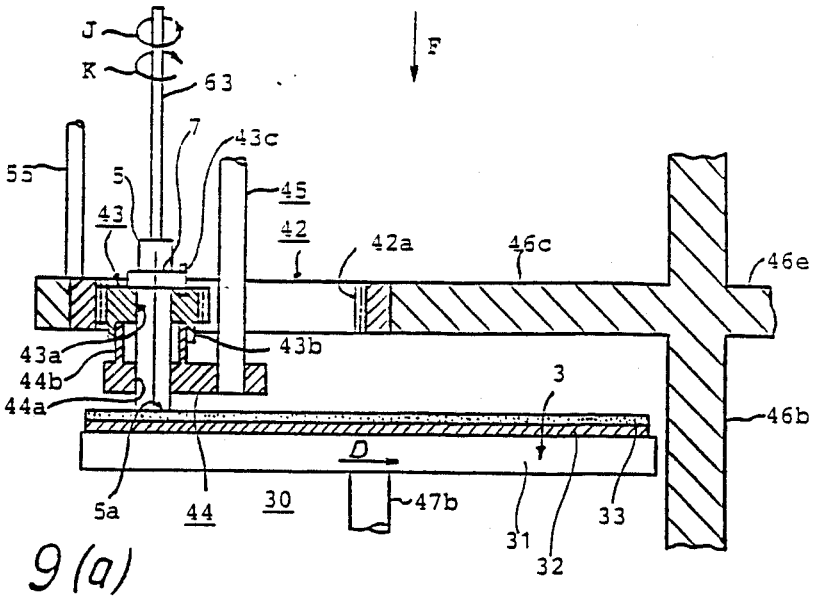
Figure 9B:
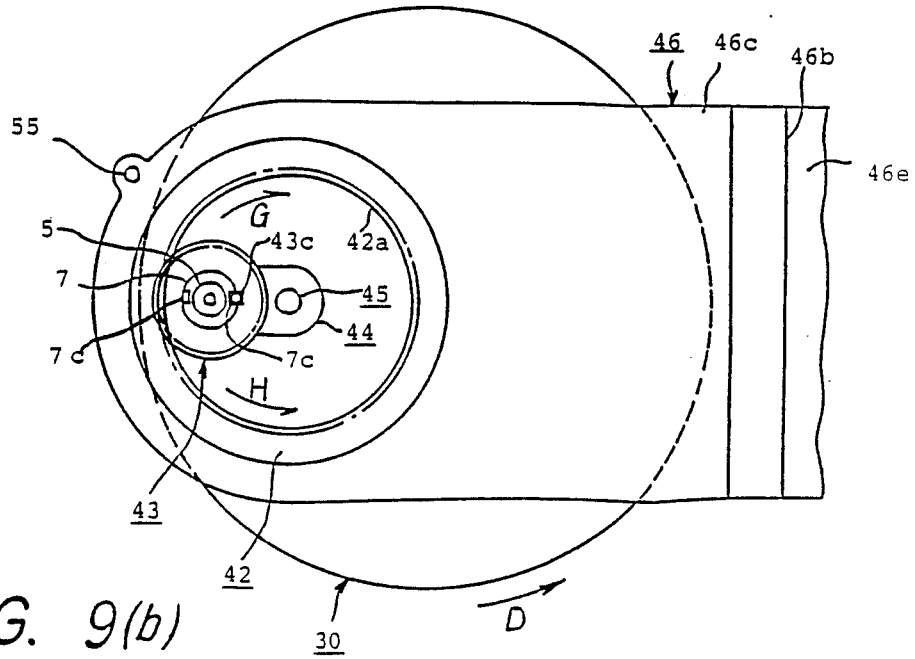
Figure 11:
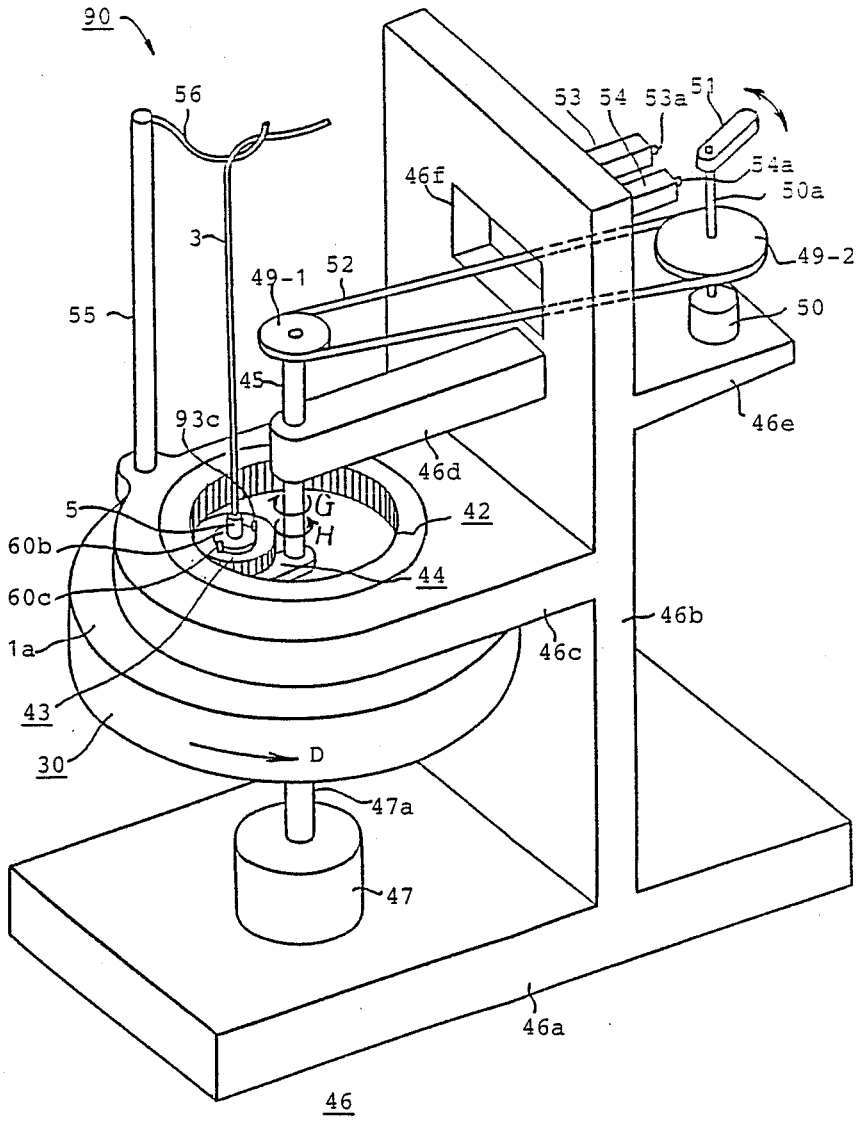
FIG. 11 is a perspective view of a polishing machine which is provided with the components of FIG. 9.

FIG. 9 is a schematic view which illustrates the machines of the principal portions of an embodiment of the present invention, wherein FIG. 9(*a*) is its side elevation view and FIG. 9(*b*) is its plan view observed from the direction of the arrow F. FIG. 11 is a schematic perspective view of a polishing machine comprising the essential parts of FIG. 9. Hereinafter, the left hand side of the machine as shown in FIG. 9 and FIG. 11 will be referred to as the front side of the machine, while the right hand side will be referred to as the back side, and the right and left hand sides looking from the front side of the machine toward its back side are respectively referred to as the right side and the left side.

Basically, this embodiment comprises, as shown in FIGS. 9 and 11, a rotatable polishing plate 30 of which the upper surface is flat, an internal gear 42 arranged and fixed above polishing plate 30, and a small gear 43 which is arranged to interact with the internal teeth 42*a* of internal gear 42. The small gear 43 is provided with an insert hole 43*a* at the center thereof for receiving the ferrule 5. This small gear 43 is rotatably supported from its lower side by a support cylinder 44*b* attached to one end of a gear support plate 44 which is arranged between the rotatable polishing plate 30 and the small gear 43. The other end of the gear support plate 44 is supported by a perpendicular shaft 45 which is arranged concentrically with the internal gear 42.

As shown in FIG. 11, the main frame 46 comprises a platform 46*a*, a vertical panel 46*b*, a front shelf 46*c*, an arm 46*d* which is projected forward from the vertical panel 46*b*, and a back shelf 46*e* which is projected backward from the vertical panel 46*b*. The upper part of the vertical panel 46*b* is provided with a window 46*f*. A motor 47 for driving the polishing plate 30 is placed on the front side of the platform 46*a*, and is connected to the polishing plate 30 with a shaft 47*a*. In this embodiment, the polishing plate 30 is driven in the direction of the arrow D (counterclockwise). The internal gear 42 is embedded in and fixed to the front shelf 46*c*, and its teeth are engaged with the teeth of the small gear 43. The small gear 43 is provided with a small insert hole 43*a* at its center for receiving the ferrule. As mentioned before, the internal gear 43 is rotatably supported by the gear support plate 44. A shown in FIG. 9(*a*), the gear support plate 44 is provided with a hole 44*a* which is arranged coaxially with the small gear 43 and allows the ferrule 5 to be rotatably inserted therethrough. The support cylinder 44*b* provided around the insertion hole 44*a* slidably engages with a cylindrical sleeve 43*b* provided at the lower side of the small gear 43. So, the small gear 43 is rotatably supported from its lower side.

When the shaft 45 is rotated, the teeth of small gear 43 are in engagement with the internal teeth of the internal gear 42. Since the teeth of both gears are engaged to each other, the small gear 43 rotates around its axis while revolving around the shaft 45. Therefore, if the ferrule 5 is fixed in the insert hole 43*a*, the end face 5*a* of the ferrule moves on the surface of the polishing plate 30 while revolving and rotating at the same time.

As shown in FIG. 11, the drive shaft 45 is rotatably held by the arm 46*d*, and maintained perpendicularly. A pulley 49-1 is provided on the upper end of the drive shaft 45. A motor 50 is placed on the back shelf 46*e*, and another pulley 49-2 is provided on the shaft 50*a* of the motor 50. A belt 52 is trained between the pulleys 49-1 and 49-2 through the window 46*f*. A pair of limit switches 53 and 54 are arranged on the vertical panel 46*b* with a predetermined distance therebetween. The limit switches 53 and 54 are each provided with a respective push button 53*a* and 54*a*. The buttons are pushed by a lever 51 when the motor shaft 50*a* has been rotated through a predetermined angle to the left or right, and each time the lever 51 pushes a switch, the direction of rotation of the motor 50 is reversed.

The reference numeral 55 indicates a pole fixed to the front shelf 46*c*. The pole 55 is provided with a holding member 56 to hold the optical cable 3 which has its terminal end connected to the ferrule 5.

The diameter of the rotatable polishing plate 30 is 10 cm in one embodiment. As shown in FIG. 9(*a*), plate 30 is composed of a rotatable disk 31, an elastic plate 32 which is placed on said rotatable disk 31, and a thin metal polishing disk 33 which is placed on the elastic plate 32. In an embodiment of the invention, the elastic plate 32 is made of a rubber plate having a thickness of 2 mm, and the polishing disk 33 is made of a copper plate which is 0.15 mm thick. Abrasives are applied on the surface of the polishing disk 33. The grit of the abrasives may be varied according to the requirements of the polishing step.

Figure 8A:
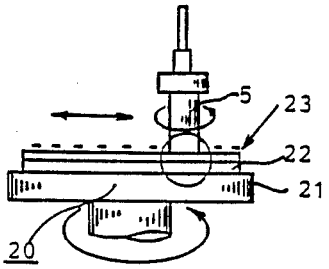
Figure 8B:
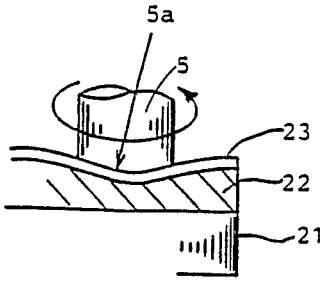

As has been described before, when the ferrule is pressed against the polishing plate, the surface of the polishing disk 33 is indented as shown in FIG. 8(*b*). So, the end face 5*a* of the ferrule 5 is polished in accordance with the depression or indentation of the surface of the polishing disk 33. Since the ferrule 5 itself is given a rotating and revolving motion against the surface of the rotating polishing disk 33, the end face of the ferrule is finished substantially to a spherical surface. The radius of curvature can be varied by varying the pressure applied to the ferrule to press it toward the polishing disk.

Figure 10:
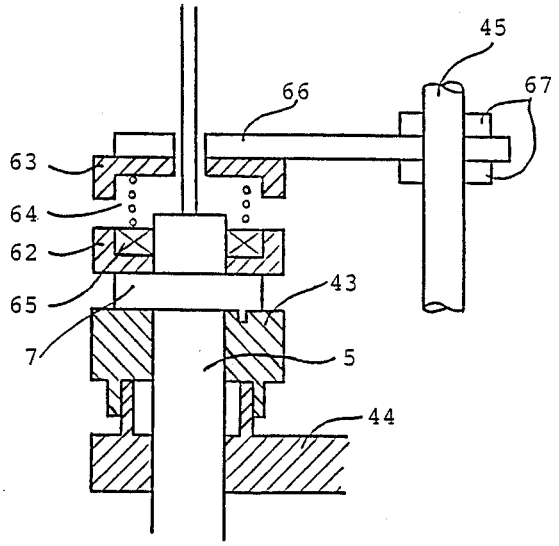
FIG. 10 is a schematic sectional view which illustrates the mechanism for adjusting the pressure applied on the ferrule to press it toward the polishing plate of FIG. 9.

FIG. 10 illustrates an example of a mechanism for adjusting the pressure of the ferrule. This mechanism is not shown explicitly in FIGS. 9 and 11 for simplicity. A cap 62 comprising a bearing 65 is placed on a flange 7 of a ferrule 5, and the bearing 65 is pressed downward by a spring 64. The other end of the spring 64 is supported by an upper cap 63 attached to an upper holder plate 66, and the latter is fixed to the drive shaft 45 by a nut 67. The spring force can be adjusted by adjusting the fixing point of the upper holder plate 66 on the drive shaft 45, thereby the pressure applied to the ferrule 5 is adjusted.

A process for polishing a ferrule by such a polishing machine is as follows. The polishing plate 30 is rotated by the motor 47 as shown in FIG. 11. The ferrule 5 is inserted into the insert hole 43*a* (FIG. 9(*a*)) of the small gear 43 from its upper side, with the notch 7*c* of the flange 7 of the ferrule 5 aligned with a corresponding notch of the small gear 43, and the position of the ferrule 5 is fixed by a pin 43*c*. So, the ferrule 5 is thus fixed to the small gear 43. Next, the ferrule 5 is pressed downward by the pressing mechanism (FIG. 10) arranged on the upper holder plate 66 (FIG. 10), and the end face 5*a* of the ferrule is pressed against the surface of the polishing disk 33 with a predetermined pressure (50 g for example). Next, the drive shaft 45 is driven by the motor 50 (FIG. 11) alternatively to the left and right in the direction of arrows G and H (FIG. 9) around its axis within a predetermined angle. This angle is determined by the angular range of rotation of the lever 51 around the shaft 50*a*, because the motor 50 reverses its direction of rotation each time a switch button 53*a* or 54*a* is pressed by the lever 51. Such reciprocating motion is important to prevent the optical cable 3 from contacting the arm 46*d*.

Synchronized to the reciprocating rotation of the gear support plate 44, the small gear 43 revolves around the drive shaft 45, and at the same time the small gear 43 alternately rotates to the right or left around its own axis in the directions shown by arrows J or K in FIG. 9(*a*). It is designed that the rotation angle of the small gear 43 about its own axis be more than 360°. So, the end face of the ferrule 5 is revolved and rotated in clockwise and anticlockwise directions on the surface of the polishing disk 33.

In an embodiment, the diameter of the polishing plate 30 was 10 cm, and its speed of rotation was 15 r.p.m. The diameters of the internal gear 42 and the small gear 43 were respectively 4 and 1.5 cm. The small gear 43 is revolved ±120°, and during such period it is rotated ±360°. Such rotating angle is determined so that the optical fiber is not excessively twisted.

The second feature of the present invention is explained in accordance with an embodiment thereof. It is essential to keep an adequate amount of abrasives at the contact point between the ferrule and the polishing disk for making an abrasion smooth and obtaining a uniform and high quality finishing. In an ordinary polishing machine, however, the abrasives are pushed aside by the ferrule and drop off from the polishing plate. So, only a fractional portion of the abrasive material is supplied at the contact point between the ferrule and the polishing disk.

To prevent such an occurrence, in the present invention, structure is provided on the surface and periphery of the polishing disk. FIG. 12 is a plan view of the polishing disk 23 or 33 as explained with reference to FIGS. 8 or 9. As shown in FIG. 12, a series of grooves 34 are formed in a mesh pattern in the polishing area on the surface of the polishing disk 33. Such grooves can be formed on a metal plate by press work for example. Further, a ring collar 35 is provided on the periphery of the polishing disk 33. FIG. 13 is a partially cut-out enlarged view of the polishing disk 33 shown in FIG. 12.

When polishing is carried out using such polishing disk, the abrasives supplied on the surface of the polishing disk 33 do not drop off even if they are pushed aside by the ferrule. The abrasives are damned by the ring collar 35, and they recycle to the polishing area along the grooves 34. Therefore, there is no need to provide surplus abrasives as is necessary when an ordinary polishing machine is used. According to the polishing method of the present invention, the abrasives are always retained in the grooves even if they are pushed aside by the ferrule. And as shown in FIG. 14(*a*), when the ferrule 5 is in a polishing position, the polishing disk 33 is warped concavely by the pressure of the ferrule. So, the abrasives gush out from the grooves 34 and they wet the end face 5*a* of the ferrule 5 from beneath.

In an embodiment of the present invention, the mesh patterned grooves have been formed by press work on the surface of the polishing disk 33 made of copper plate. The pitch of the mesh was 5 mm, and the depth and width of the grooves were both 0.05 mm.

The ring collar may be formed by press work, but it is more practical to instead use a ring frame 37 as shown in FIG. 14(*b*). The ring frame 37 is screwed to the rotatable disk 31. Using such ring frame 37 the polishing disk 33 is fixed onto the elastic plate 32. With such structure, the polishing disk 33 can be replaced very easily when it is worn.

A third feature of the present invention is that, the chuck or holder for holding the ferrule and loading it in the polisher is releasably mounted on the polishing machine. Thus, not only can the ferrule be positioned easily in the machine but also such feature facilitates prevention of contamination or strain by abrasives which might undesirably adhere to parts resulting in decrease of the accuracy of the machine. Such feature will be explained referring to an embodiment of the ferrule polishing machine shown in FIG. 17.

According to the results of experiments, it has been shown that the end face of the ferrule is polished with sufficient smoothness into a spherical form even if it is not revolved during the polishing process. Optical fiber connectors, the ferrules of which were polished only by rotation around their own axis and without revolution, had excellent characteristics and reproducibility. In the polishing machine of FIG. 17, therefore, the ferrule is not revolved but it is only rotated. Namely, the ferrule holder 72 is rotatable around its own axis but it does not revolve.

Figure 15A:
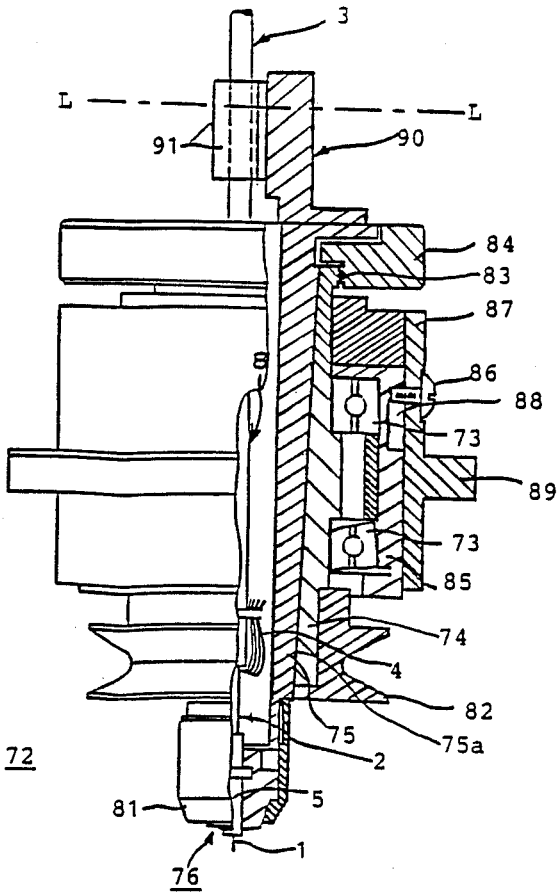
Figure 15B:
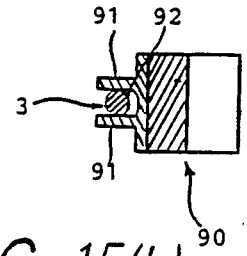

FIG. 15(*a*) illustrates a holder part to be used for setting the ferrule in the polishing machine which will be explained later. The holder part comprises a rotary part which is held by bearings 73. The rotary part comprises an external cylinder 74 fixed to the bearings 73, and in internal cylinder 75, which is releasably mounted in the external cylinder 74 by a taper 75*a*. The external cylinder 74 is provided with a pulley 82 at one end thereof, while the internal cylinder 75 is provided with a chuck 76 for fixing a ferrule 5. As will be apparent from the figure, the chuck 76 can be removed in an upwardly direction together with the internal cylinder 75 when the latter is removed from the external cylinder 74.

Figure 16:
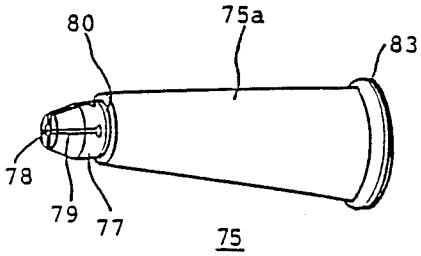
FIG. 16 is a perspective view of a chuck to be used in an embodiment of the present invention.

FIG. 16 illustrates the structure of the internal cylinder 75. The external surface 75*a* of the internal cylinder 75 is tapered and is engaged with the internal taper of the external cylinder 74. The chuck 77 is provided with an insert hole 78 at its top. The insert hole 78 has a larger diameter than the ferrule, and along the insert hole the chuck is provided with longitudinal cuts 79. Therefore, the effective diameter of insert hole 78 can be varied by engaging the chuck cover 81 with a screw 80 formed at the base part of the chuck 77. The ferrule 5 is inserted into insert hole 78 from the side of the tapered part 75*a*, and is then clamped in the chuck 77 by tightening the chuck cover 81.

The internal cylinder 75 is then fixed to the external cylinder 74 by pressing the former into the latter to engage the taper 75*a* with the internal taper of the external cylinder. Release of the internal cylinder 74 from the external cylinder 74 is accomplished by rotating a nut 84 attached to a screw 83 provided on the other end of the external cylinder 74. This helps to pull the engaged taper part 75*a* out of the external cylinder 74.

The bearings 73 which hold the rotary part are supported by an outer cylinder 85. This outer cylinder 85 is fixed, as shown in FIG. 15(*a*), to a case 87 with a fixing screw 86. The outer cylinder 85 is provided with a groove 88 in its axial direction and the position of the outer cylinder can be adjusted precisely along its axial direction within the length of the groove 88. The holder part 72 described above can be fixed to the polishing machine (not shown) with a flange 89 provided around the case 87.

The ferrule to be polished has the following size for example. The diameter of the optical fiber is 90 μm, the diameter of the secondary coated fiber is 125 μm, the diameter of the ferrule attached to the fiber is 2.5 mm and the diameter of the flange provided around the ferrule is 4 mm. The external diameter of holder part 72 is 4 cm. From these data, one will be able to deduce the size of other parts of said holder part.

Figure 17:
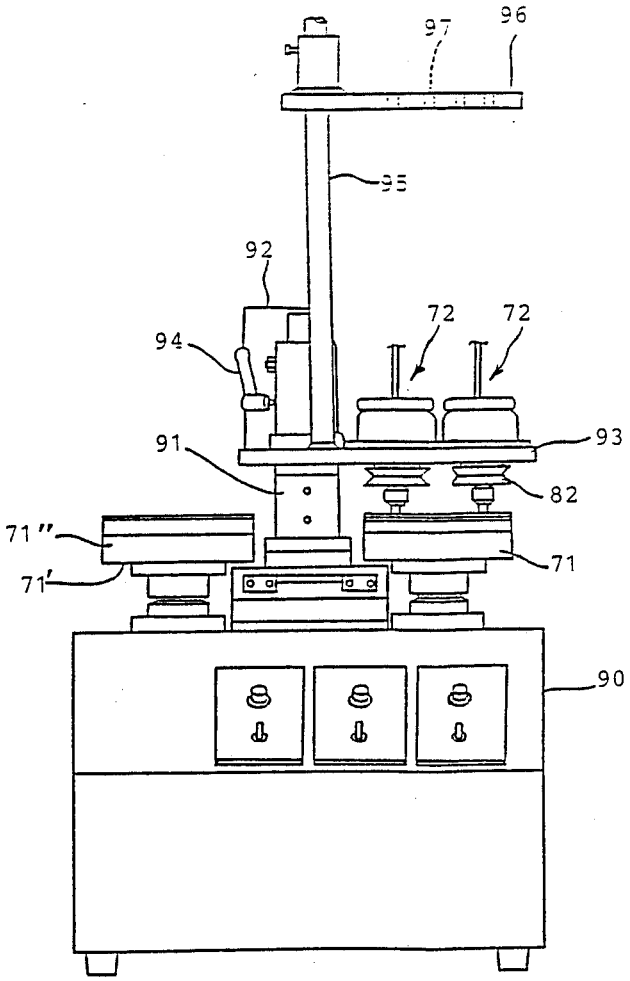
Figure 17:
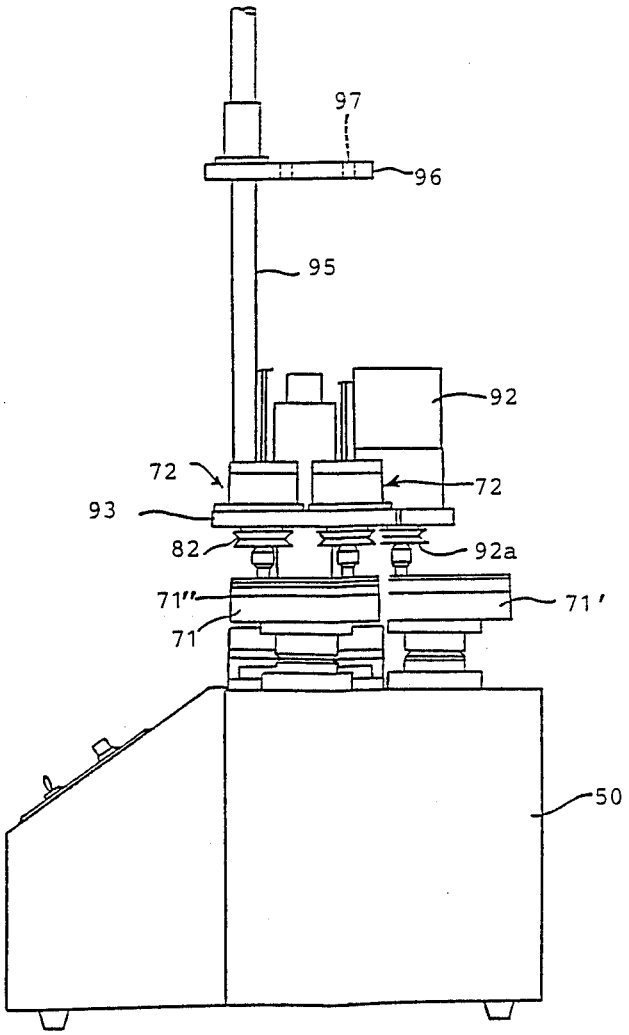

FIGS. 17(*a*) and (*b*) illustrate respectively the front elevation and side elevation of the polishing machine with which the holder part described above is used. A rough polisher 71', a middle polisher 71'' and a final polisher 71 are provided on the upper panel of a controller 90. These polishers are driven by a motor 92. The controller 90 comprises control circuits, a power supply circuit and timers etc. A supporter 91 is provided on the controller cabinet. The supporter 91 is provided with a deck 93 on which a drive motor 92 and a plurality of said holder parts 72 are arranged. The deck 93 can be rotated horizontally around the supporter 91 and also can be moved vertically by sliding along the supporter 91. Deck 93 can also be fixed into a desired position by tightening a lever 94. Therefore, the ferrule 5 loaded in a holder part 72 and set on the deck 93 can be placed in contact with any of the desired polishers 71, 71' or 71'' with a predetermined pressure.

Though it is not shown explicitly in the figure, a drive belt consisting of an elastic material is trained around the pulley 92*a* of the drive motor 92 and the pulleys 82 of each holder part 72, and in this embodiment a total of four holder parts are provided, so these holder parts are all driven by the motor 92.

A post 95 fixed to the deck 93 is provided with a guide plate 96, and the optical cables extending from each holder part 72 are supported by a hole 97 in said guide plate 96, to protect the cables from heavy bending or twist.

Each of the polishers 71, 71' and 71'' are constructed in the manner described above with respect to FIGS. 8, 12 or 14. The polishing disk of the rough polisher 71' is made from a tin plate for example, and the polishing disks of the middle and final polishers (71'' and 71) are each made of a copper plate having a thickness of 0.15 mm for example. Each of the polishing disks is fixed on a rubber sheet for example, in the manner described with respect to FIG. 14(*b*). With regard to the abrasives, a paste containing diamond powder is used. The grain size of the diamond powder is varied according to the polishing step. For example, a paste containing a grain size of 3 μm was used for both the rough polisher 71' and the middle polisher 71'', and a paste containing a grain size of $\frac{1}{4}$ μm was used for the fine polisher 71.

A polishing operation by the polisher of FIG. 17 is as follows. The ferrule 5 to be polished is mounted in the chuck 76 by the method explained before. The chuck is then inserted from the upper side of the holder part 72 and fixed by the taper 75*a* of the holder part 72. The lever 94 is loosened to rotate the deck 93 to the rough polisher 71', and the deck is slid downwardly so that the ferrule is in contact with the polishing disk of the rough polisher 71'. Then, the motor 92 is switched on to drive the polisher. So, the holder part 72 rotates to the left and right with a speed of 10 r.p.m. for example. The rough polishing is continued for 30 sec. for example. The polishing disk of the rough polisher 71 is made of tin, which has small elasticity, so the polished surface of the ferrule becomes configured as an almost flat cone having its crest on the center axis of the ferrule. The rough polisher 71' is not necessarily provided with the elastic sheet beneath the polishing disk.

After rough polishing for a predetermined period, the second and the final polishing steps are executed in a similar manner after the deck 93 is rotated to the respective polisher. In these polishers, since the polishing surface is made of copper plate mounted on an elastic plate, the polishing is performed in the manner described above with respect to FIG. 8. So the polisher surface is finished to a substantially spherical face.

In the embodiment described with respect to FIG. 17, four holder parts 72 are provided. So, four ferrules can be polished at the same time. The scale of mass production can be varied by increasing or decreasing the number of holder parts 72. Moreover, it is also possible to further enhance the production rate by executing other polishing steps with other polishing plates while one polishing plate is performing one step of polishing (final polishing for example).

In the embodiment of FIG. 17, the ferrule was rotated, but it was not revolved. However, it will be easy for those skilled in the art to design a polisher which can rotate and revolve the ferrule at the same time as described with respect to FIG. 9 or FIG. 11.

Figure 1:
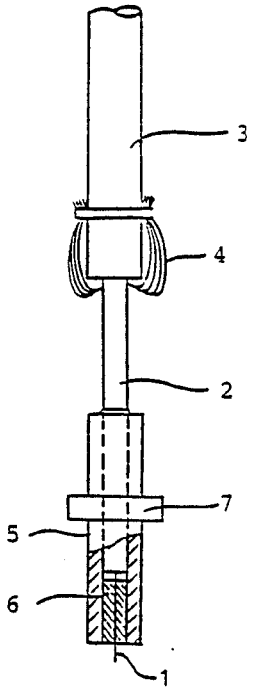
FIG. 1 PRIOR ART
FIG. 1 is a schematic side elevation view for explaining the construction of the ferrule and an optical fiber.
Figure 2:
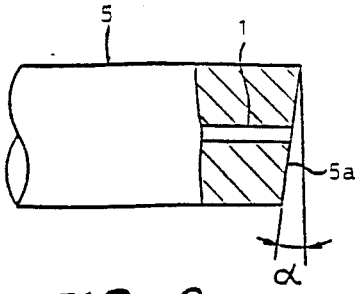
FIG. 2 PRIOR ART
FIG. 2 is a partial cut-away side elevation view illustrating a prior art configuration where the end face is machined relative to a right angle surface because the end face of the ferrule is not correctly polished.
Figure 4:
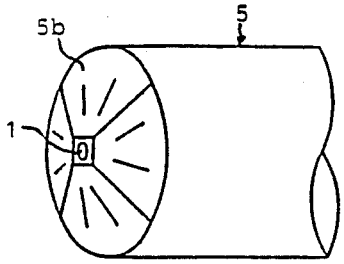
FIG. 4 PRIOR ART
FIG. 4 is a partial perspective view of a ferrule having an end face which is polished like a pyramid.
Figure 3:
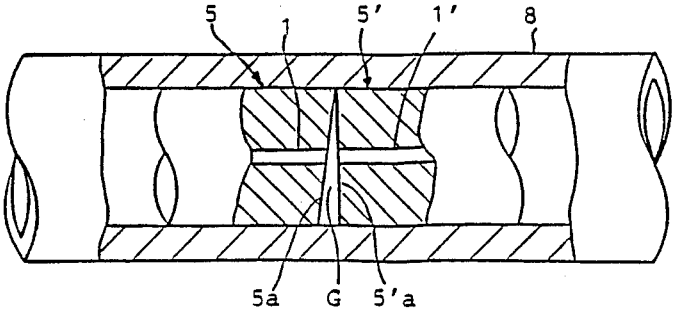
FIG. 3 PRIOR ART
FIG. 3 is a schematic partially cut-out side elevation view which illustrates the typical construction wherein the ferrules are inserted from both sides of a sleeve in order to connect the optical fibers.
Figure 7A:
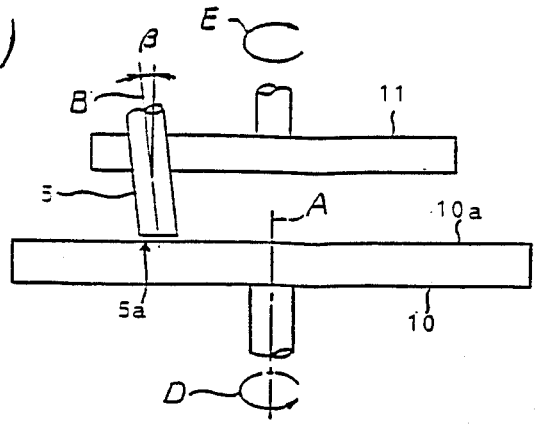
FIG. 7(a) PRIOR ART
Figure 7B:
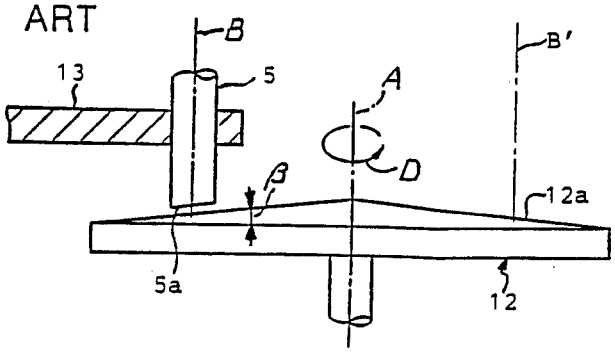
FIG. 7(b) PRIOR ART
Figure 7C:
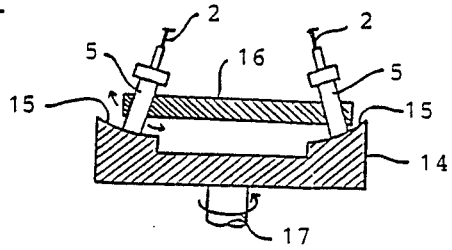
FIG. 7(c) PRIOR ART

As explained before, the polishing machine of the present invention accomplishes polishing by alternately reversing the rotational direction of the ferrule around its axis. So, the optical fiber 3 mounted to the polisher is not excessively twisted. But as shown in FIG. 1, since the tension member 4 has been removed from the secondary coated fiber 2 at a point close to the part which is inserted into the ferrule, the bared secondary coated fiber 2 is apt to be twisted strongly. Such twist is undesirable for the optical fiber cable, because it may damage the portion of the secondary coated fiber 2 that is adhered to the ferrule 5. For eliminating such disadvantage, the present invention further proposes a cable holder attached to the rotating holder.

In FIG. 15 is shown an embodiment of the holder which includes a support member 90 which is formed integrally with the holder part 72. More precisely, member 90 is provided on the upper face of internal cylinder 75 of the ferrule holder. A sectional view taken along view line L—L of FIG. 15(*a*) is shown in FIG. 15(*b*). The support member 90 is provided with a holding member 91. As shown in FIG. 15(*b*), the holding member 91 has a longitudinal cut-out groove 92 at its center. The cut-out groove 92 is positioned on the axis of the ferrule holder part 72, and its width is smaller than the diameter of the optical cable 3. Therefore, after the ferrule 5 is fixed to the chuck 76 of the internal cylinder 75, the optical cable 3 is pushed into the cutout groove 92, and it is fixed in the cut-out groove by its elasticity and friction. So, even if the internal cylinder is moved during insertion into the cylinder 74, or is rotated for polishing the ferrule, the exposed secondary coated optical fiber 2 is neither pulled nor twisted.

The above described structure of the support member and holding member are only by way of example, and it is apparent that these structures can be designed in various ways. But it is essential that the optical cable 3 should be integrally held with the ferrule holder part, more precisely, the optical cable should be held integrally with the internal cylinder 75 of the holder part. Then neither tension nor torque will occur at the bared secondary coated optical fiber 2 due to motion of the ferrule holder.

Figure 18:
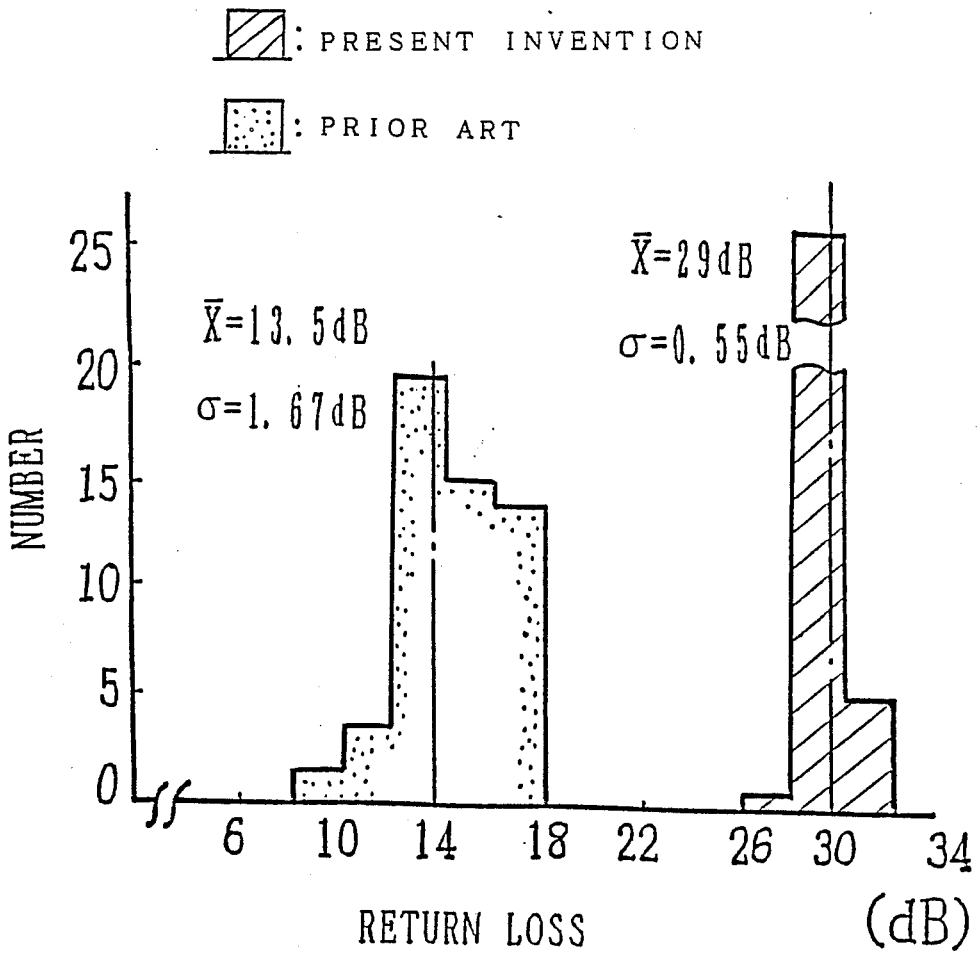
Figure 19:
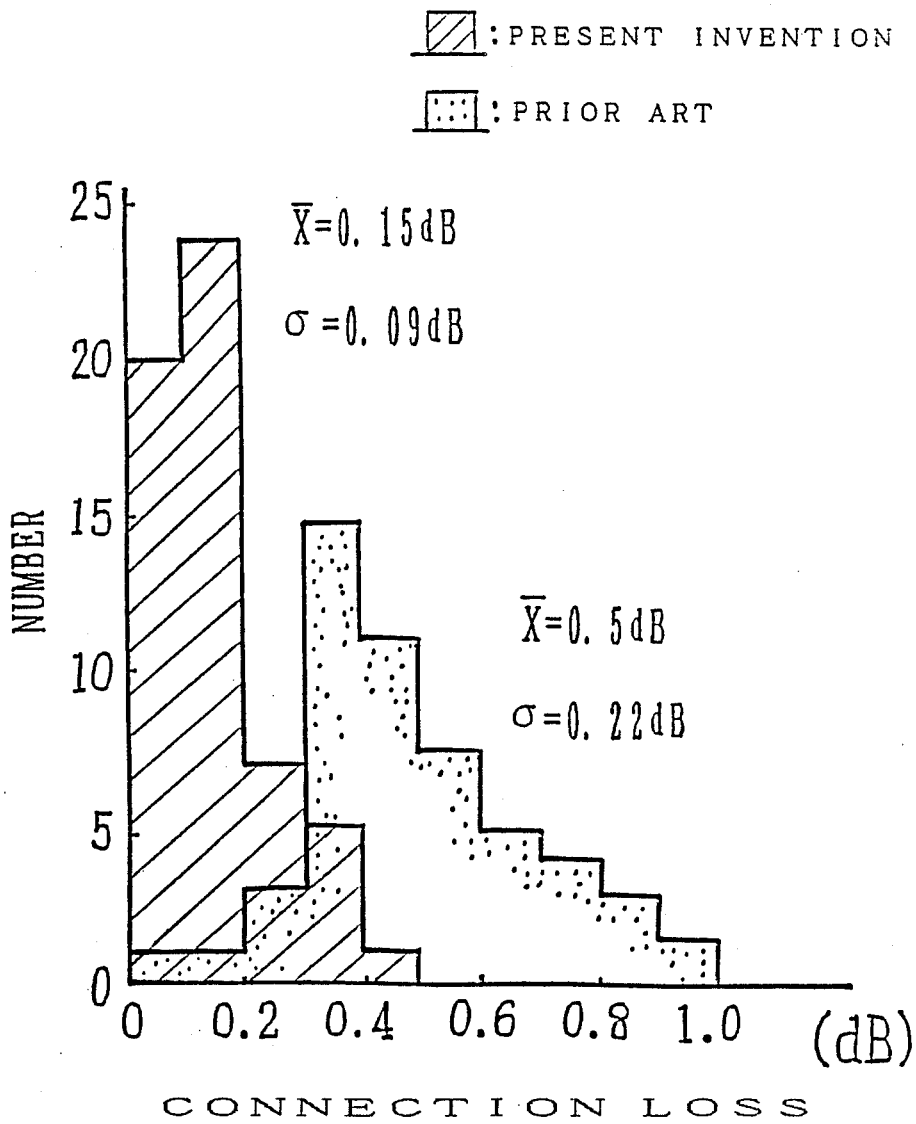

The effects of polishing the end face of ferrule with a polishing machine of the present invention are shown in FIGS. 18 and 19. The return losses and connection losses of two groups of optical fiber connectors were measured. The ferrules of the first group of connectors were polished using a prior art polisher, while the ferrules of the second group were polished using the polisher of the present invention. The measured values of the return losses and connection losses of these connectors were plotted respectively on the charts of FIGS. 19 and 18. The abscissas of these charts are respectively the return loss and connection loss, and the ordinates are the number of connectors having corresponding loss characteristics. In the charts, the distribution of measured values for the first group is presented in the dotted area, and the distribution of values for the second group is presented in the cross hatched area.

As can be seen in FIG. 18, the mean value $\overline{X}$ of the return loss of the connector polished using a prior art polisher is 13.5 dB, but it is improved to 29 dB in the connectors polished using the polisher of the present invention (the larger value indicates a smaller loss). And as can be seen in FIG. 18, the measured values for the second group are dispersed over a narrower range than are the measured values of the first group. The dispersion $\sigma$ has been calculated as 1.67 dB for the first group, and it is calculated as 0.55 dB for the second group. FIG. 19 is a chart presenting data corresponding to the connection loss of the connectors. The mean value for the first group (polished by a prior art procedure) is 0.5 dB, while the mean value for the second group (polished by the polisher of the present invention) is improved to 0.15 dB (the smaller value indicates a lower loss). The dispersion of the loss is also improved from 0.22 dB to 0.09 dB. A smaller dispersion means that the connection is more stable and reproducible. Accordingly, it will be apparent that the polishing machine of the present invention is very effective for polishing the end faces of optical fiber connectors.

While the invention has been described with respect to some preferred embodiments, it is to be understood that the present invention is not to be limited in any way, by the specific embodiments, but is intended to cover any and all changes and modifications which are possible within the scope of the appended claims.

What is claimed is as follows:

1. A polishing machine for polishing the end faces of elongated ferrules supporting coaxially aligned optical fibers to be connected in an optical fiber connector, said polishing machine comprising:

a rotating disk having a flat face:

a rubber plate on said rotating disk, said rubber plate being capable of elastic deformation under the influence of compression applied on its surface;

a thin copper polishing disk on said rubber plate, said polishing disk being capable of elastic deformation under the influence of compression applied on its surface;

means for pressing the end face of a said ferrule against the surface of said polishing disk with the longitudinal axis of the ferrule disposed generally perpendicularly to the surface of said rotating disk;

means for rotating said ferrule alternately in opposite directions within a predetermined angle around its longitudinal axis;

means for revolving said ferrule around an axis parallel to and spaced laterally from its longitudinal axis alternately in opposite directions within a predetermined angle on the surface of said polishing disk;

means for detecting that said ferrule has been rotated through a predetermined angle and outputting a detection signal; and means for switching the rotational and revolving directions of said ferrule in response to said detection signal.

2. A polishing machine according to claim , wherein said polishing disk has grooves on its surface arranged in a mesh pattern.

3. A polishing machine according to claim 1, wherein said polishing disk has a cylindrical collar arranged around its perimeter.

4. A polishing machine according to claim 1, wherein said polishing disk is provided with a ring-shaped collar removably mounted on the peripheral edge of the polishing disk and operably attached to the rotating disk for removably holding the polishing disk on said elastic plate, at least a portion of said ring projecting above the surface of said polishing disk to present retaining dam surrounding said polishing disk.

* * * * *

UNITED STATES PATENT AND TRADEMARK OFFICE

CERTIFICATE OF CORRECTION

PATENT NO. : 4,839,993

DATED : June 20, 1989

INVENTOR(S) : Takayuki Masuko, Norio Suzuki and Kaoru Moriya

It is certified that error appears in the above-identified patent and that said Letters Patent is hereby corrected as shown below:

FRONT PAGE [73] Assignee: "Fujisu" should be --Fujitsu--;

FRONT PAGE, Column 2, line 2, "Showalter" should be --Showalter, Jr.--

Column 2, line 51, "firs" should be --first--.

Column 4, line 9, "he" should be --the--.

Column 5, line 15, "aid" should be --said--.

Column 12, line 53, "cutout" should be --cut-out--.

Column 14, line 31, "claim ," should be --claim 1,--.

line 53, after "present" insert --a--.

Signed and Sealed this

Seventeenth Day of April, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,839,993

DATED : June 20, 1989

INVENTOR(S) : Takayuki Masuko, Norio Suzuki and Kaoru Moriya

It is certified that error appears in the above-identified patent and that said Letters Patent is hereby corrected as shown below:

FRONT PAGE [30] Foreign Application Priority Data: "61-038033" should be --61-038033 [U]--.

Signed and Sealed this

Twelfth Day of June, 1990

*Attest:*

HARRY F. MANBECK, JR.

*Attesting Officer*

*Commissioner of Patents and Trademarks*